United States Patent [19]

Wisniewski

[11] Patent Number: 4,949,432

[45] Date of Patent: Aug. 21, 1990

[54] EYEGLASS HOLDER

[76] Inventor: Ronald C. Wisniewski, 2605 Bauernschmidt Dr., Baltimore, Md. 21221

[21] Appl. No.: 322,678

[22] Filed: Mar. 13, 1989

[51] Int. Cl.[5] ..... A44B 21/00

[52] U.S. Cl. ..... 24/3 C; 24/3 G; 24/3 E; 24/336

[58] Field of Search ..... 24/3 C, 3 G, 3 E, 3 F, 24/13, 237, 336, 563

[56] References Cited

U.S. PATENT DOCUMENTS

| | | | |
|---|---|---|---|
| 617,962 | 1/1899 | Kirby | 24/3 G |
| 727,204 | 5/1903 | Rogers | 24/336 |
| 853,544 | 5/1907 | Fernald | 24/336 |
| 881,757 | 3/1908 | Winsor | 24/3 E |
| 1,170,859 | 2/1916 | Walker | 24/3 E |
| 1,671,555 | 5/1928 | Skultety | 24/3 E |
| 2,637,080 | 5/1953 | Nemser | 24/13 |
| 4,055,873 | 11/1977 | Kallman | 24/3 C |
| 4,619,020 | 10/1986 | Lecher, Sr. | 24/3 E |
| 4,771,515 | 9/1988 | Guarro | 24/3 C |

*Primary Examiner*—Victor N. Sakran
*Attorney, Agent, or Firm*—Walter G. Finch

[57] ABSTRACT

An improved holder to be securely and removably attached to a garment, such as a shirt or jacket, and for holding a pair of eyeglasses, by securely and removably attaching to the temple bars of the eyeglasses. The holder includes a body formed of resilient metal or plastic shaped and folded to effectively form two adjoining substantially U-shaped clips, comprising openings transverse to each other and relatively concentric planar legs extended in transverse and opposite U-shaped directions from adjacent sides of a common central relatively parallel planar leg. The clips are lined with a cut loop fabric or similar material.

6 Claims, 3 Drawing Sheets

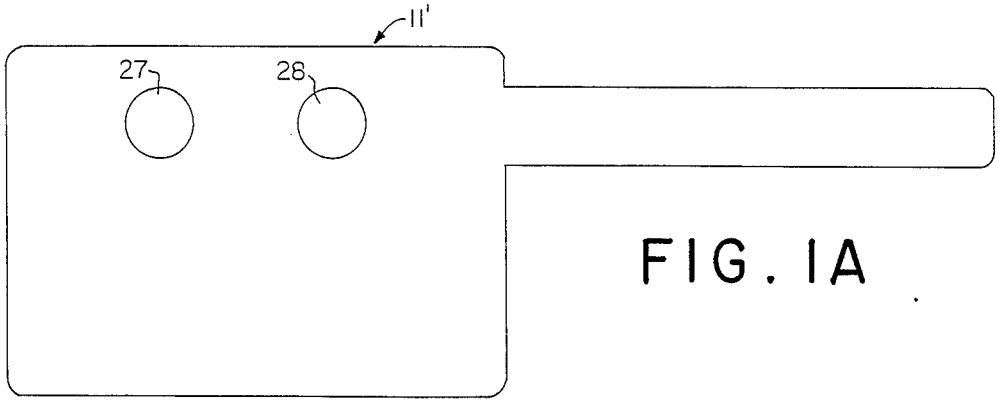
FIG. 1A
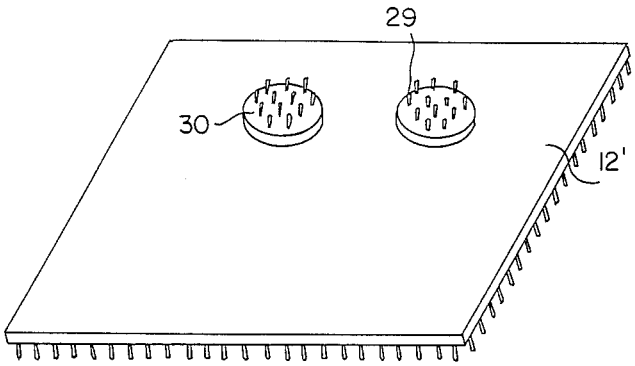
FIG. 7A
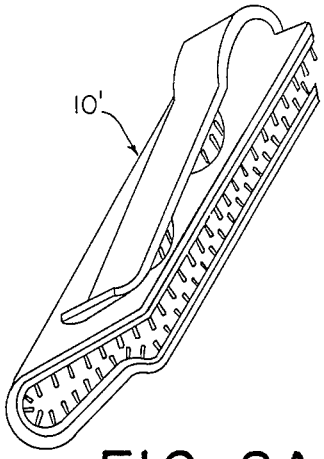
FIG. 2A
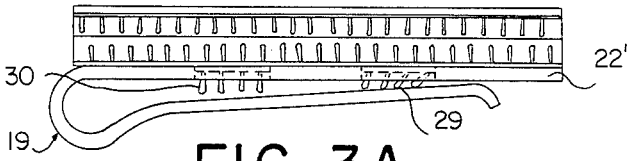
FIG. 3A
FIG. 4A
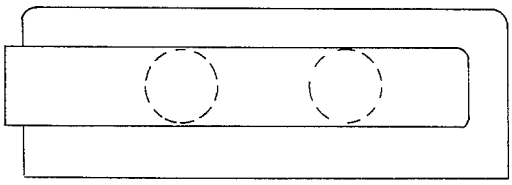
FIG. 5A
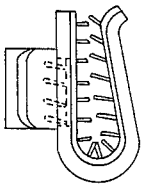

EYEGLASS HOLDER

This invention relates to improvements in detachable eyeglass holders and more especially to holders for use on the temple bars of eyeglasses.

In the field of eyeglass holders there is a need for a simple rugged eyeglass holder made of a unitary plate, that is inexpensive to produce, that positively holds a wide range of eyeglasses having a varying range of temple bars and a wide range of garment fabrics and similar objects, that can be quickly and easily attached to and separated from the eyeglass temple and garment or similar object, independent of the other, and will not cause damage to the finish of the eyeglass temple or damage to the garment.

Prior disclosure relating to this field include the following U.S. Pat. Nos. 439,423; 1,322,966; 2,097,371; 2,570,670; 2,670,886; 3,508,691; 4,055,873; 4,055,874; 4,458,384; and Fed. Rep. of Germany Pat. No. 2,728,906.

The above mentioned holders are lacking in adequately satisfying all the needs as aforementioned.

Accordingly, it is an object of this invention to satisfy those needs.

More specifically it is an object of this invention to provide a holder to be securely and removably attached to a garment, such as a shirt pocket or similar object, and for holding a pair of eyeglasses by securely and removably attaching to the temple bars of the eyeglasses and to be removably attached to either the garment or temple bars independent the other.

A further object of this invention is to provide a holder with a body formed from a unitary L-shaped plate of resilient metal, plastic, or similar material, shaped and folded upon itself, which effectively form two transverse substantially U-shaped flat hinged type clips, each having a relatively concentric and planar leg extended in a transverse and opposite U-shape direction from one of the adjacent sides of a central common parallel planar leg, where one clip allows entry of an eyeglass temple on one planar side of the common leg and the other clip transversely allows entry of a garment or similar object on the other planar side of the common leg.

An additional object of this invention is to provide a holder of the character described having a clip that has the inner surface covrerd with a cut loop fabric, or similar material, to increase the positive holding power for a wider range of temple bars and to cushion and prevent damage to the finish of the temple bars.

Another object of this invention is to provide a holder of the character described having a clip that has one side of the inner surface covered with a cut loop fabric, or similar material, to increase the holding power to a garment or similar object.

Still another object of this invention is to provide a low cost machine formed eyeglass holder of the character described, which can be used for a variety of eyeglass temples and garments and other similar objects, and which can be readily fabricated in various sizes and modifications to meet the needed requirements.

Other objects and advantages of this invention will become apparent from the following specifications, claims and accompanying drawings.

FIG. 1A is top plan view of flat L-shaped resilient plate prior to shaping to form an alternate embodiment of the invention having holes cross sectionally through the center common leg.

FIG. 2A is a perspective view of the alternate embodiment of the invention

FIG. 3A is top plan view of the alternate embodiment of the invention

FIG. 4A is a front plan view of the alternate embodiment of the invention

FIG. 5A is a side plan view of the alternate embodiment the invention.

FIG. 7A is a perspective view of the cut loop fabric prior to folding and attaching to the alternate embodiment of the invention

Figure 1:
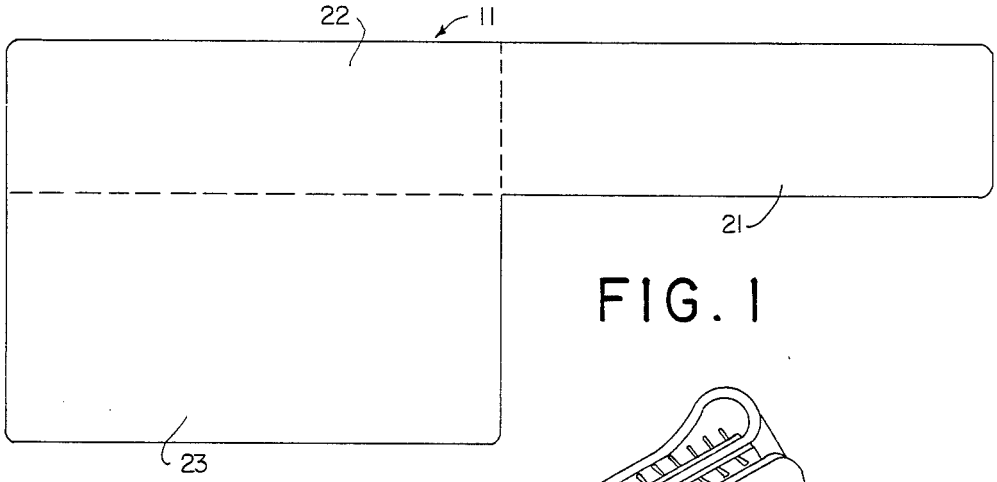
FIG. 1 is a top plan view of flat L-shaped resilient plate prior to shaping and illustratively divided by broken lines into three leg sections.
Figure 2:
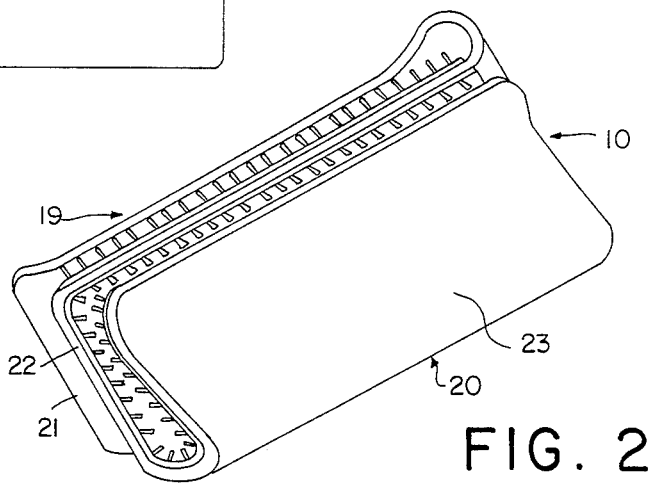
FIG. 2 is a perspective view of the invention
Figure 3:
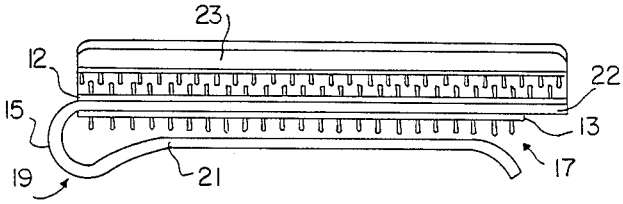
FIG. 3 is a top plan view of the invention.
Figure 4:
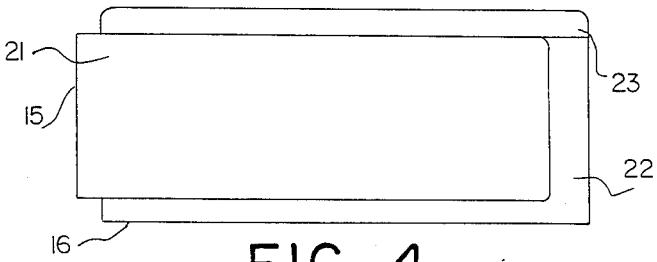
FIG. 4 is front plan view of invention.
Figure 5:
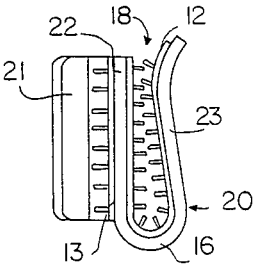
FIG. 5 is a side plan view of the invention.

In FIG. 1. is shown a substantially L-shaped flat plate made of resilient metal, plastic, or similar material, broadly denoted with the numeral 11 and divided by broken lines to illustrate the three leg sections 21, 22, and 23.

Figure 6:
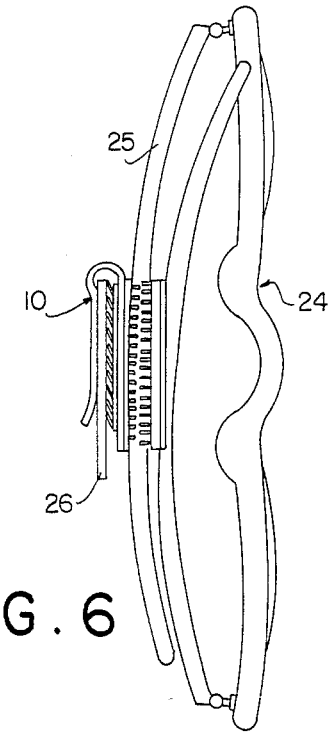
FIG. 6 is a side view of the invention showing how the holder receives and holds a temple bar of a pair of eyeglasses in place.

In FIG. 2–5 is shown the holder broadly denoted by the numeral 10 formed by folding longitudinally, leg section 21 of plate 11 abreast leg section 22, to form a substantially U-shaped flat hinged-type clip broadly denoted with the numeral 19, comprising a bight 15, a mouth opening 17, and a relatively planar outer leg 21 longitudinally relatively parallel and concentric to common leg 22, and longitudinally arcuate at the mouth end to facilitate entry and securely holding of the eyeglass temple bar 25 as shown in FIG. 6. Leg section 23 of plate 11 is folded laterally and transversely abreast the reverse face of leg section 22, to form a transverse substantially U-shaped flat hingedtype clip broadly denoted with the numeral 20, comprising a bight 16, a mouth opening 18, and a relatively planar outer leg 23, transversely relatively parallel and concentric to common leg 22, and transversely arcuate at the mouth end and shorter in length to the common leg 22 to facilitate entry, transverse to clip 19, of garment or similar object 26 as shown in FIG. 6.

The inner surface of clip 20 is covered with a cut loop material 12, or similar material, to increase the holding power for a wide range of eyeglasses having a varying range of temple bars, and to cushion and prevent appreciable movement of the secured temple bar without causing damage to its finish. One side of the inner surface of clip 19 is covered with a cut loop fabric 13, or similar material, to increase the holding power for a wide range of garments or similar objects and not cause damage to them.

The selection of the resilient plate material 11 is important. The plastic, metal, or similar material must have the proper thickness and spring quality to enable repeated use without breaking or deforming, and provide sufficient compression and resilience.

The cut loop fabric 12 and 13 or similar material must have the proper thickness and density, resilience and durability to enable repeated use, without matting or premature wear and provide sufficient frictional holding power, cushioning and protection to the finish of the eyeglass temple bar.

FIG. 1A–7A illustrates an alternate embodiment of the invention in which a holder 10', substantially the same as holder 10 having holes 27 and 28 cross sectionally through the center common leg 22' through which protrudes towards the garment clip side a cut loop material 29 and 30 attached to the back side of the loop fabric 12' or similar material to increase the holding power for a wide range of garments and reducing the chances of dislodging the fabric upon entry of the garment and to help position and keep in place the temple bar fabric.

Figure 8:
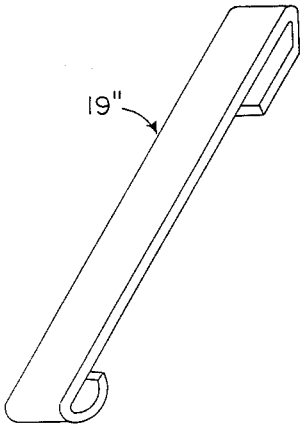
FIG. 8 is a perspective view of a garment clip made separate from the temple bar clip of another alternate embodiment of the invention
Figure 9:
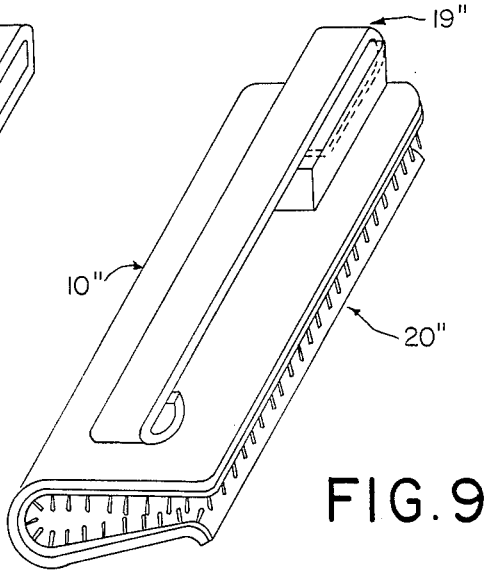
FIG. 9 is a perspective view of the other alternate embodiment of the invention in which the separately made clips are assembled.

FIG. 9 illustrates another alternate embodiment of the holder in which the holder broadly denoted as 10'', substantially the same as holder 10 has a temple bar clip 20'' made separate from that of the garment clip 19'' illustrated in FIG. 8 and is attached to the temple bar clip by some means.

Figure 10:
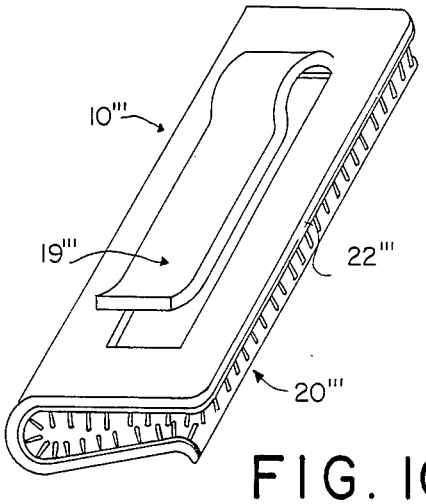
FIG. 10 is a perspective view of still another alternate embodiment of the invention having a garment clip formed from a central portion of the common central leg.

FIG. 10 illustrates yet another embodiment of the invention in which a holder 10''' substantially the same as holder 10 has a garment clip 19''' formed from the punched out or cut out central portion of the common center leg 22'''.

It will be apparent from the foregoing that the new dual transversely adjoining relatively flat U-shaped hinged type clips incorporating a cut loop fabric linings has been disclosed, and that such dual clip lends itself to a variety of applications. The dual clips are easily and removably attached to a wide range of eyeglass temple bars and garments or similar objects to securely hold the eyeglasses when not in use, without damage to either the temple bar or garment, and can removably attach to either independent of the other.

Having thus described the invention in four embodiments thereof, it is recognized that departures may be made therefrom without departing from the spirit and scope of the invention.

What I claim is:

1. A holder for a pair of eyeglasses with temple bars comprising a body formed of resilient material, shaped and folded to form two adjoining transverse substantially U-shaped flat hinged-type clips, said resilient material having three leg sections, with said first hinged-type clip being formed of two of said three leg sections folded longitudinally to form a substantially U-shape flat hinged-type clip having a bight at one end and a mouth at the opposite end, and a second hinged-type clip being formed of a third leg section folded laterally across the reverse face of one of two leg sections and having a bight at one end and a mouth at the opposite end, one of said clips comprising a relatively parallel planar outer leg extending from a central relatively parallel planar common central leg in a U-shaped direction abreast and concentric to one face of said common leg with said outer leg as measured longitudinally being shorter in length to said common leg and transversely arcuate at the mouth to facilitate inserting and securely and removably attaching of a garment or similar object; with said other clip being arranged transversely to said first clip comprising a relatively parallel planar outer leg extending in a transverse and opposite U-shape direction from the adjacent side of said common leg abreast and concentric to the reverse face of common leg and being arranged longitudinally arcuate near the mouth end to facilitate inserting and securely and removably attaching an eyeglass temple bar thereto.

2. A holder as recited in claim 1, wherein the inner surfaces of the clip designated for holding said eyeglass temple bar is lined with a cut loop fabric to increase the positive holding power of a wide range of eyeglasses having a varying range of temple bars and to cushion and prevent damage to the finish of said temple bars.

3. A holder as recited in claim 1, where the clip designated for attaching to said garment or similar object is lined on one side or both with a cut loop material to increase the frictional holding power for a wide range of garment fabrics or similar objects.

4. A holder as recited in claim 1 wherein said center common leg has at least one cross sectional hole through which protrudes, towards the garment clip side, a cut loop fabric or similar material attached to the back side of the cut loop fabric to similar material, lining the inner surface of said clip designated for holding said eyeglass temple bar, thereby providing additional holding power for fine garments and even more holding power to garments when said temple bar is inserted, thereby flexing outwardly through said at least one hole and toward the garment clip side of the cut loop material and helps position and keep in place said temple bar clip lining material and decreases the chances of dislodging the cut loop fabric or similar material upon detaching and attaching to a garment.

5. A holder as recited in claim 1 wherein said temple bar clip is made separate from said garment clip which is attached to said temple bar clip.

6. A holder as recited in claim 1 wherein the garment leg is formed from a cut out portion of said common center leg.

* * * * *